United States Patent [19]

Messner et al.

[11] 4,386,873

[45] Jun. 7, 1983

[54] DEVICE FOR DRAINING SANDY GROUND AREAS

[76] Inventors: Franz Messner, Radfeld Nr. 126, Radfeld, Austria, A-6240; Adolf Unterwaditzer, Kramsach 321a, Kramsach, Austria, A-6233

[21] Appl. No.: 218,011

[22] Filed: Dec. 18, 1980

[30] Foreign Application Priority Data

Dec. 19, 1979 [AT] Austria ..... 7998/79

[51] Int. Cl.[3] ..... A47L 11/292

[52] U.S. Cl. ..... 405/36; 15/98; 15/119 R

[58] Field of Search ..... 405/36–39, 405/258; 15/119 R, 119 A, 98

[56] References Cited

U.S. PATENT DOCUMENTS

| | | | |
|---|---|---|---|
| 2,996,743 | 8/1961 | Noble | 15/119 A X |
| 3,038,192 | 6/1962 | McNeill | 15/98 X |
| 3,079,620 | 3/1963 | Hunter | 405/36 UX |
| 3,161,905 | 12/1964 | Dryden | 15/119 A X |
| 3,789,449 | 2/1974 | MacFarland et al. | 15/98 X |
| 3,950,812 | 4/1976 | Mohr | 15/98 |

FOREIGN PATENT DOCUMENTS

| | | | |
|---|---|---|---|
| 1121690 | 5/1956 | France | 15/119 A |

*Primary Examiner*—Dennis L. Taylor

*Attorney, Agent, or Firm*—Wenderoth, Lind & Ponack

[57] ABSTRACT

A device for draining sandy ground areas, such as tennis-courts, includes an air pump, water separating elements and a suction device. A suction pipe connects the pump to the water separating elements and the water separating means to the suction device. In order to prevent sand from being removed from the ground during the draining process, the suction device has a relatively large inlet is covered by an open-pore, elastic foam plastics material.

8 Claims, 3 Drawing Figures

DEVICE FOR DRAINING SANDY GROUND AREAS

BACKGROUND OF THE INVENTION

1. Field of the Invention

This invention relates to a device for draining ground areas, particularly for draining sandy ground areas, such as tennis-courts, sand-tracks and the like.

2. Description of the Prior Art

A device of the above-mentioned type has already been described in GB-PS 1 033 500 and comprises a perforated hollow metal roller mounted on a chassis and adapted to roll on the ground to be drained. The chassis carries a water tank, which is first linked to a suction pump and second to a suction nozzle arranged within the metal roller and immediately above that portion of the roller which is in contact with the ground. During operation, the water entering into the metal roller through the perforations is sucked up by the suction nozzle and conveyed into the water tank.

The range of application of such device is very limited, and such can be employed only for draining ground areas which have solid surfaces or which are covered by grass. This is due to the fact that, when draining sandy ground areas, components thereof enter into the metal roller together with the water. Such sand components are then sucked up by the suction nozzle and conveyed into the water tank. The air speed in the nozzle must be relatively high, which creates a further adverse effect in such prior art device.

For draining sandy ground areas, it is further known to employ rollers which are covered by sponges, the water which is sucked up by the sponge being squeezed into a basin by means of a squeezing roller arranged on the rear side of the roller with respect to the moving direction. This device also has the disadvantage that the sand which has been removed from the ground and which sticks to the surface of the sponge roller is also conveyed into the basin. This is a particularly adverse situation, since still further layers of sand will be removed from those regions of the ground surface on which puddles have been formed because of cavities.

SUMMARY OF THE INVENTION

It is, therefore, the object of this invention to improve a device of the afore-described type, ensuring quick draining of ground areas independent of their surface structure and without removing material from the ground.

According to the invention, this is achieved by a device comprising an air pump, water separating elements and a suction, a suction pipe connecting the pump to said water separating elements and the water separating elements to the suction device, the suction device having an inlet covered by a filter adapted to contact the ground area to be drained.

Hence, sand or earth particles are prevented from entering into the suction pipe, not by retaining the sand particles on a filter layer but by widening the suction inlet, thus reducing the speed of the air and the water to a value below that value at which sand particles are swept along. It is disadvantageous to employ filter layers whose apertures are smaller than the size of the particles as such filter layers will soon be clogged.

It has proved particularly advantageous to employ filters of elastic open-pore foam plastics material with a specific weight preferably in the range of between 20 and 40 kg/m$^3$. Such foam plastics material ensure particularly effective draining by means of large suction inlets.

When draining large puddle-like water areas, it is of advantage to employ a suction device having a cup-shaped hollow body communicating with the suction pipe, the open face of such hollow body directed towards the ground being covered by a plate of foam plastics material forming the filter.

It is of advantage to provide the cup-shaped hollow body with spacing devices resting on the ground. For draining large ground areas covered with a relatively thin water layer, the suction device comprises a cylindrical hollow roller, the jacket of such roller being perforated and covered with a layer of open-pore foam plastics material.

In order to ensure a continuous operation of the device, it is of advantage to provide that the water separating elements comprise two collecting tanks, first valve means alternately connecting the lower fittings of the collecting tanks to the suction pipe and a discharge pipe, respectively, second valve means alternately connecting the upper fittings of the collecting tanks to the inlet and outlet of the air pump.

BRIEF DESCRIPTION OF THE DRAWINGS

In the following the invention will be described in greater detail with reference to the accompanying drawings, without being limited thereto, and wherein.

DESCRIPTION OF THE PREFERRED EMBODIMENTS

Figure 1:
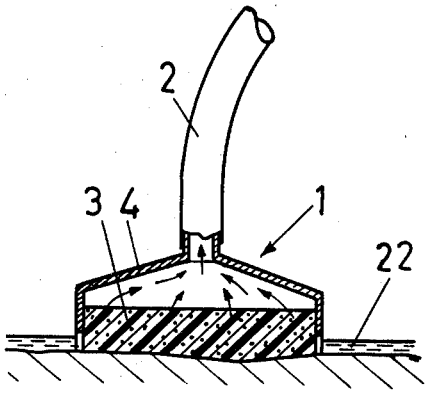
FIG. 1 is a cross-sectional view of a first embodiment of a suction element for a ground are covered with relatively deep puddles.

FIG. 1 shows a suction device 1 which is particularly suitable for draining sandy ground areas, such as tennis-courts, sand-tracks, etc., covered with relatively deep puddles. Each suction device 1 comprises a cup-shaped hollow body with a suction pipe 2 connected to its upper side. Hollow body 4 rests on the ground by spacing elements. The open face of body 4 directed towards the ground is closed by an elastic member 3 formed of open-pore foam plastics material. When the suction pipe 2 is linked to the suction inlet of an air pump, the water which is on the ground penetrates into the foam plastics material of member 3 and mounts therein until it is swept along because of the high air speed in the suction pipe 2. The speed at which the water 22 penetrates into the foam plastics material is not sufficient, however, to sweep along particles from the ground. Particles floating in the water are also deposited on the foam plastics material of member 3. The cooperation between the capillary force of the foam plastics material of member 3 and the reduced pressure in the cup-shaped body 4 is essential to the invention.

Figure 2:
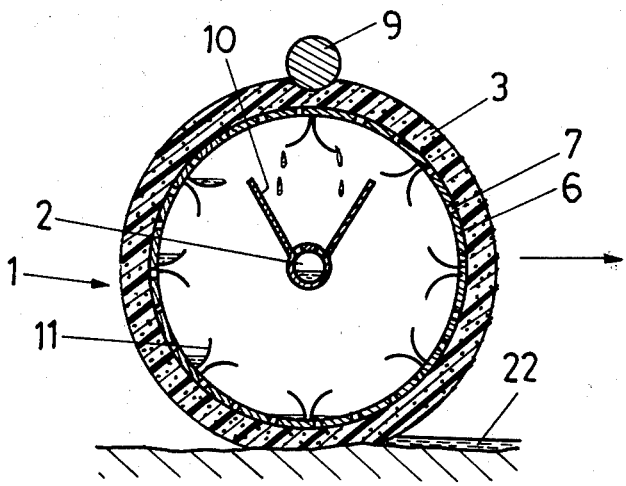
FIG. 2 is a cross-sectional view of an embodiment of a suction element for large ground areas.

FIG. 2 shows an embodiment of the suction device 1 according to the invention which is particularly suitable for draining large grounds covered with relatively thin layers of water.

Figure 3:
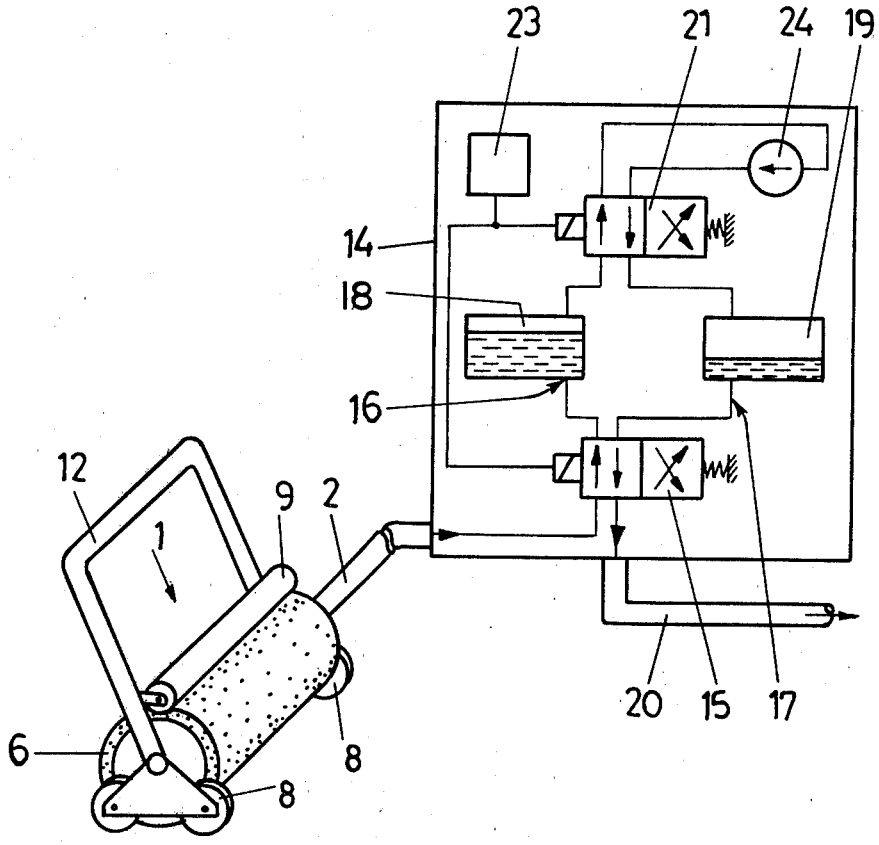
FIG. 3 is a schematic view of the entire device.

The suction device 1 comprises a cylindrical roller 6 whose surface is provided with perforations 7 for the water and is covered with an elastic member 3 formed of open-pore foam plastics material. A device 9 for compressing the foam member 3 is arranged on the upper side of the roller 6. Inside the roller 6 at a position below device 9 is provided a basin 10 which communicates with a suction pipe 2 extending coaxially of the roller 6. The inner surface of the cylindrical roller 6 is provided with axially extending scoops 11 which are arranged in pairs radially diverging towards the inside. As can be seen in FIG. 3, the roller 6 rests on the ground by means of wheels 8 arranged on both side faces, so that the region of contact of the foam plastics material of the member 3 with the ground is compressed by a pre-set dimension.

During operation, a reduced pressure is generated in the internal space of the roller 6 because of the connection with the suction pipe 2. The roller 6 rolls on the ground, and the water lying on the ground penetrates into the region of contact between the foam plastics material of member 3 and the ground. Because of the capillary effect of the foam plastics material of member 3 and the reduced internal pressure, the water is conveyed to the area of the compressing device 9. The water there is pressed through the perforations 7 and runs into the basin 10.

Water which is already in the region of contact between the foam plastics material of member 3 and the ground or which enters inside the roller is also conveyed to a position above the basin 10 by means of the scoops 11 and then is deposited into basin 10. As the scoops are arranged in pairs, the roller 6 can be operated by means of the handle 12 in any moving direction.

In order to prevent sand from being displaced by the surface of the member 3, when moving the roller, it has proved advantageous to employ rollers having a diameter of more than approximately 300 mm. The thickness of the foam plastics material of member 3 is approximately 40 mm, whereas the extent of compression in the region of contact between the foam plastics material of member 3 and the ground should be preferably about 15 mm. The specific weight of the foam plastics material of member 3 is preferably between approximately 20 and 40 kg/m$^3$.

FIG. 3 shows a schematic view of a device according to the invention in which the suction device 1 is connected to pump means 14 by a suction pipe 2. This embodiment is suitable for continuously draining large ground areas. Pump means 14 may be mobile or stationary, whereby suction pipes which are adapted to be coupled to the suction means 1 have to be laid on the ground to be drained.

The pump means 14 includes two collecting tanks 18 and 19 serving as water separating elements. Each of the tanks is provided with lower fittings 16 and 17, respectively, and alternately is connectable to the suction pipe 2 and a discharge hose 20 by means of a first multipath valve 15. By means of a second multipath valve 21, the tanks 18 and 19 are connectable alternately to the inlet and outlet of an air pump 24. The two valves 15 and 21 are actuated by time control means 23. During operation, time control means 23 actuates the two valves 15 and 21 into the illustrated position for a pre-set time so that the fitting 16 of the tank 18 is connected to the suction pipe 2. Tank 18 is connected to the suction inlet of the air pump 24. The water which is contained in the air flowing through the suction pipe 2 is deposited in the tank 18. At the same time, the outlet of the air pump 24 is connected to the tank 19, whereas the fitting 17 of tank 19 is connected to the discharge hose 20 by means of the valve 15. Thus, the water contained in the tank 19 is pressed into the hose 20. After expiration of the pre-set time, the time control means 23 reverses the two valves 15 and 21 so that the tank 18 is now filled with water, whereas the tank 19 is discharged. Hence, relatively small size water tanks can be employed in the pump means 14 according to this invention.

It is obvious that a number of variations are possible without departing from the scope of the present invention.

What is claimed is:

1. An apparatus for draining water from ground areas, particularly sandy ground areas, without removing particles such as sand from the ground areas, said apparatus comprising:

suction means for contacting a ground area and for withdrawing water therefrom, said suction means comprising a closed, hollow cylindrical roller having a perforated peripheral wall, and a layer of elastic, open-pore foam plastics material covering the entire outer surface of said peripheral wall;

means mounting said roller for rolling movement over a ground area to be drained such that said layer is compressed by contact with the ground area by a predetermined dimension;

air pump means, connected to the interior of said roller by pipe means, for applying to said interior of said roller a vacuum sufficient to ensure that, in cooperation with said predetermined dimension, the water to be drained from the ground area is drawn into said interior of said roller through said layer and said perforations, while particles such as sand on the ground area are prevented from passing into said layer, and for removing said water along with air from said interior of said roller; and water separating means, connected by said pipe means between said air pump means and said roller, for separating said removed water from said air.

2. An apparatus as claimed in claim 1, wherein said mounting means comprise wheels supporting said roller.

3. An apparatus as claimed in claim 1, further comprising a basin mounted within said interior of said roller for continuous communication with said pipe means, and a plurality of axially extending scoop means, mounted on the inner surface of said wall of said roller, for, during movement of said roller over the ground area, lifting said water from said interior of said roller and depositing said water into said basin, whereafter said water then is removed from said basin through said pipe means by said vacuum.

4. An apparatus as claimed in claim 3, wherein said scoop means are directed in opposite, generally circumferential directions, such that said water is lifted and deposited in said basin upon rolling movement to said roller in opposite directions.

5. An apparatus as claimed in claim 1, wherein the diameter of said roller is greater than approximately 300 mm, and the thickness of said layer is approximately between 30 and 50 mm.

6. An apparatus as claimed in claim 1 or claim 5, wherein said predetermined dimension comprises approximately 15 mm.

7. An apparatus as claimed in claim 1 or claim 5, wherein said foam plastics material has a specific weight of between 20 and 40 kg/m$^3$.

8. An apparatus as claimed in claim 1, wherein said water separating means comprises first and second water collection tanks, each of said water collection tanks including respective upper and lower fittings, a water discharge, first valve means for connecting alternately said lower fittings of said first and second water collection tanks to said interior of said roller and to said water discharge, and second valve means for connecting alternately said upper fittings of said first and second water collection tanks to an inlet and to an outlet of said air pump means.

* * * * *